US009651893B2

(12) United States Patent
Asaka

(10) Patent No.: US 9,651,893 B2
(45) Date of Patent: May 16, 2017

(54) IMAGE FORMING APPARATUS AND METHOD OF CONTROLLING IMAGE FORMING APPARATUS

(71) Applicant: KYOCERA Document Solutions Inc., Osaka (JP)

(72) Inventor: Hitoshi Asaka, Osaka (JP)

(73) Assignee: KYOCERA Document Solutions Inc., Osaka (JP)

( * ) Notice: Subject to any disclaimer, the term of this patent is extended or adjusted under 35 U.S.C. 154(b) by 0 days.

(21) Appl. No.: 15/191,161

(22) Filed: Jun. 23, 2016

(65) Prior Publication Data

US 2016/0378020 A1 Dec. 29, 2016

(30) Foreign Application Priority Data

Jun. 26, 2015 (JP) ..... 2015-128839

(51) Int. Cl.
*G03G 15/08* (2006.01)

(52) U.S. Cl.
CPC ..... *G03G 15/0831* (2013.01)

(58) Field of Classification Search
USPC ..... 399/9, 24, 25, 27–31, 109–111, 120
See application file for complete search history.

(56) References Cited

U.S. PATENT DOCUMENTS 6,343,193 B1 * 1/2002 Matsumoto ..... G03G 15/553 399/25
8,406,640 B2 * 3/2013 Fujisawa ..... G03G 15/553 399/24
9,176,451 B2 * 11/2015 Saiki ..... G03G 15/0863
9,411,290 B2 * 8/2016 Shinagawa ..... G03G 15/556

FOREIGN PATENT DOCUMENTS

JP 2006-259539 A 9/2006

* cited by examiner

*Primary Examiner* — Hoan Tran
(74) *Attorney, Agent, or Firm* — Stein IP, LLC

(57) ABSTRACT

An image forming apparatus includes a development device, a toner container which includes data indicating whether the toner container is an installation toner container or a replacement toner container and a memory storing the value of a remaining amount related item, a supply portion, a read/write portion which performs the reading and writing of the memory and a control portion which reduces the present value of the remaining amount related item according to the number of sheets printed. When in a state where installation has already been performed, the installation toner container is attached, the control portion stores, in the memory, a value based on the remaining amount of toner before the installation.

8 Claims, 6 Drawing Sheets

IMAGE FORMING APPARATUS AND METHOD OF CONTROLLING IMAGE FORMING APPARATUS

This application is based upon and claims the benefit of priority from the corresponding Japanese Patent Application No. 2015-128839 filed on Jun. 26, 2015, the entire contents of which are incorporated herein by reference.

BACKGROUND

The present disclosure relates to an image forming apparatus which uses toner to perform printing.

In an image forming apparatus which uses toner to perform printing, a development device is provided that applies the toner to an electrostatic latent image to perform development. Since the toner within the development device is reduced by the consumption of the toner, the toner is supplied from a toner container to the development device. Before the toner container in use is empty, a new toner container needs to be prepared. Hence, the remaining amount of toner within the container may be displayed.

A technology on the display of the remaining amount of toner as described below is known. Specifically, a method of displaying the remaining amount of toner is known in which when the first new toner cartridge is replaced, the number of printed dots after the start of use of the first new toner cartridge until the toner runs out and the toner cartridge is replaced is summed, the actual amount of toner consumed per dot is calculated by dividing the remaining amount of toner consumed in the first new toner cartridge by the number of printed dots summed, the remaining amount of toner is calculated by subtracting the product of the amount of toner consumed per dot and the actual number of printed dots from the amount of toner put into the second or subsequent new toner cartridge and the remaining amount of toner is notified to the outside.

SUMMARY

An image forming apparatus according to one aspect of the present disclosure includes a display, a development device, a toner container, a supply portion, a read/write portion and a control portion. The display displays information. The development device supplies toner to develop an electrostatic latent image formed on a photosensitive drum. The toner container stores the toner supplied to the development device, and a memory is attached that data indicating whether the toner container is an installation toner container or a replacement toner container and a value of a remaining amount related item which is an item related to the remaining amount of the toner are written in. The supply portion supplies the toner stored in the toner container to the development device. The read/write portion reads contents stored in the memory attached to the toner container and writes information in the memory. In the control portion, the read/write portion is made to perform update process where a present value of the remaining amount related item is gradually reduced, according to the number of sheets printed, from an initial value of the remaining amount related item, and the present value is recognized based on the reading of the read/write portion. When a predetermined installation performance condition is satisfied, the control portion makes the supply portion perform installation where the toner is put into the development device containing no toner, when the installation is performed in a state where the installation toner container is attached, a value based on the remaining amount of the toner within the container after the installation is stored as the initial value in the memory and when the installation toner container is attached in a state where the installation has already been performed, a value based on the remaining amount of the toner within the container before the installation is stored as the initial value in the memory.

Further features and advantages of the present disclosure will be more apparent from the following embodiment.

DETAILED DESCRIPTION

Figure 1:
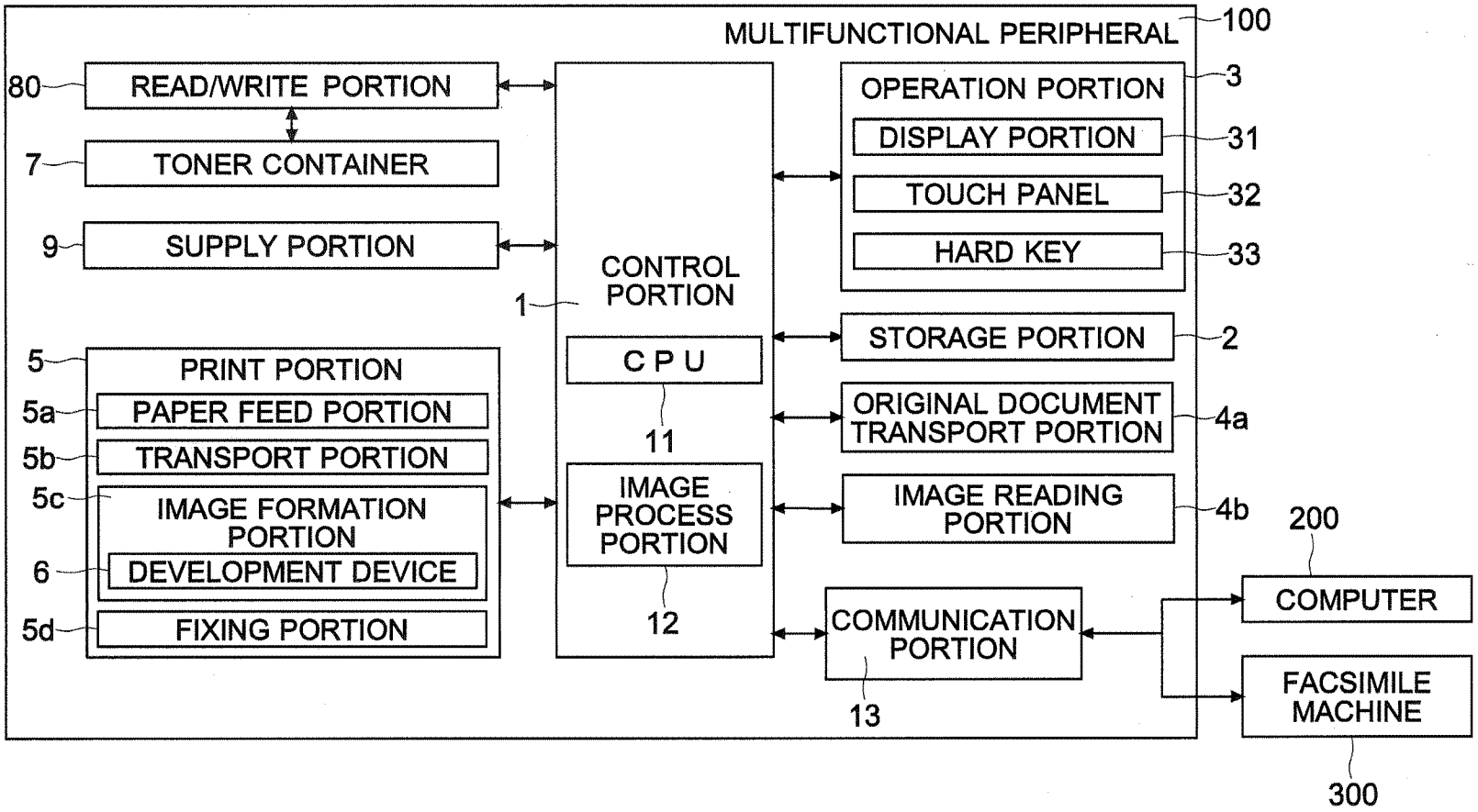
FIG. 1 is a diagram showing an example of a multifunctional machine according to an embodiment.

Some image forming apparatuses are delivered in a state where toner is not put into a development device. In such an image forming apparatus, toner is put into the development device before the start of use. The putting of the toner into the development device before the use may be referred to as "installation". The installation is performed such as when the image forming apparatus is first turned on after the delivery. An installation toner container may be packed with the image forming apparatus so that it is not necessary to prepare or purchase another toner container.

The image forming apparatus may be delivered in a state where the installation toner container (packed toner container) is attached into the image forming apparatus. The image forming apparatus may be delivered in a state where the main body of the image forming apparatus and the packed toner container are packed separately. In either case, before the start of the installation of the toner, the installation toner container is attached to the image forming apparatus.

Here, a memory (IC tag) which stores various types of data such as a model and compatible apparatuses may be attached to the toner container. In the memory, the value of an item (hereinafter referred to as a "remaining amount related item") related to the amount of toner left in the container may be stored. Each time printing is performed, the value of the remaining amount related item is updated.

In this way, it is possible to grasp the remaining amount of toner by computation without provision of a special sensor in the toner container.

In the installation, a large amount of toner is fed from the toner container into the development device. The remaining amount of toner in the installation toner container before the installation is previously determined. The amount of toner consumed in the installation is also determined. Hence, conventionally, as the remaining amount related item in the memory of the installation toner container in an unused state, a value based on the remaining amount of toner after the installation is previously written. For example, in the memory of the installation toner container, a value (a value after the installation such as ** grams) obtained by subtracting the amount of toner consumed in the installation from the amount of toner before the installation is previously stored.

However, an irregular installation in which the installation toner container is not used may be performed. Since it takes a certain amount of time to perform the installation, a dealer (vendor who sells and delivers the image forming apparatus) may use a toner container owned by the dealer to perform the installation before the delivery of the image forming apparatus to a customer. In this case, the packed toner container which is not used by the dealer is passed to the customer (should be passed thereto). When the image forming apparatus is replaced, and the toner container of the previous image forming apparatus corresponds to the new image forming apparatus, there is a possibility that a user does not use the packed toner container and sets the toner container of the previous image forming apparatus on the new image forming apparatus to perform the installation. There is also a possibility that a user who has a plurality of toner containers tries to use an older toner container so as to use a normal replacement toner container owned by the user and perform the installation.

When the installation is performed without use of the installation toner container, and the present toner container becomes empty, the present toner container may be replaced with the unused installation toner container. In other words, the installation toner container may be attached as the replacement toner container to the image forming apparatus. In this case, since the toner has already been put into the image forming apparatus, the installation of the toner is not performed (no decrease in the toner is caused by the installation). However, as the remaining amount related item of the memory in the installation toner container, a value which indicates the remaining amount of toner immediately after the installation is stored. Hence, the value of the remaining amount related item stored in the memory of the installation toner container disadvantageously and greatly differs from the actual remaining amount as the installation is not performed.

For example, when a unused installation toner container is newly attached to the image forming apparatus on which the installation has already been performed, in a state where the toner is sufficiently left in the toner container, the value of the remaining amount related item is a value corresponding to the remaining amount of zero. Consequently, the remaining amount of toner which is displayed is lower than the actual remaining amount of toner. Although the toner is sufficiently left in the toner container, a display for the remaining amount of zero and the replacement of the toner container is produced. Consequently, disadvantageously, it is likely that a new toner container is erroneously ordered due to the erroneous display of the remaining amount (the value of the remaining amount related item). The known technology described above can determine the amount of toner consumed but cannot cope with a problem in which a unused installation toner container is newly attached after the installation has already been performed.

Hence, in the present disclosure, when the installation toner container of the toner is attached as the replacement toner container, the value of the remaining amount related item previously stored in the memory of the installation toner container is adjusted to a value which corresponds to the amount of toner that is actually left. Therefore, the present disclosure will be described with reference to FIGS. 1 to 10. In the following description, a multifunctional peripheral 100 serving as the image forming apparatus is used as an example. However, individual elements such as configurations and arrangements described in the present embodiment do not limit the scope of the disclosure and are simply illustrative.

(Multifunctional Peripheral 100)

The multifunctional peripheral 100 according to the embodiment will be described with reference to FIGS. 1 and 2. The multifunctional peripheral 100 includes a control portion 1 and a storage portion 2 (see FIG. 1). The control portion 1 includes circuits such as a CPU 11 and an image process portion 12, and controls the operation of the multifunctional peripheral 100. The storage portion 2 is a combination between nonvolatile storage devices such as a ROM and a HDD and volatile storage devices such as a RAM. The storage portion 2 stores various types of data such as various types of programs and data for control, setting data and image data. The CPU 11 controls the individual portions of the multifunctional peripheral 100 and performs various types of computation process based on the programs and data stored in the storage portion 2. The image process portion 12 performs image process on image data used for printing and transmission, such as density conversion, enlargement, reduction, rotation and data format conversion. The processed image data is used for the formation of a toner image in an image formation portion 5*c* and transmission.

Figure 2:
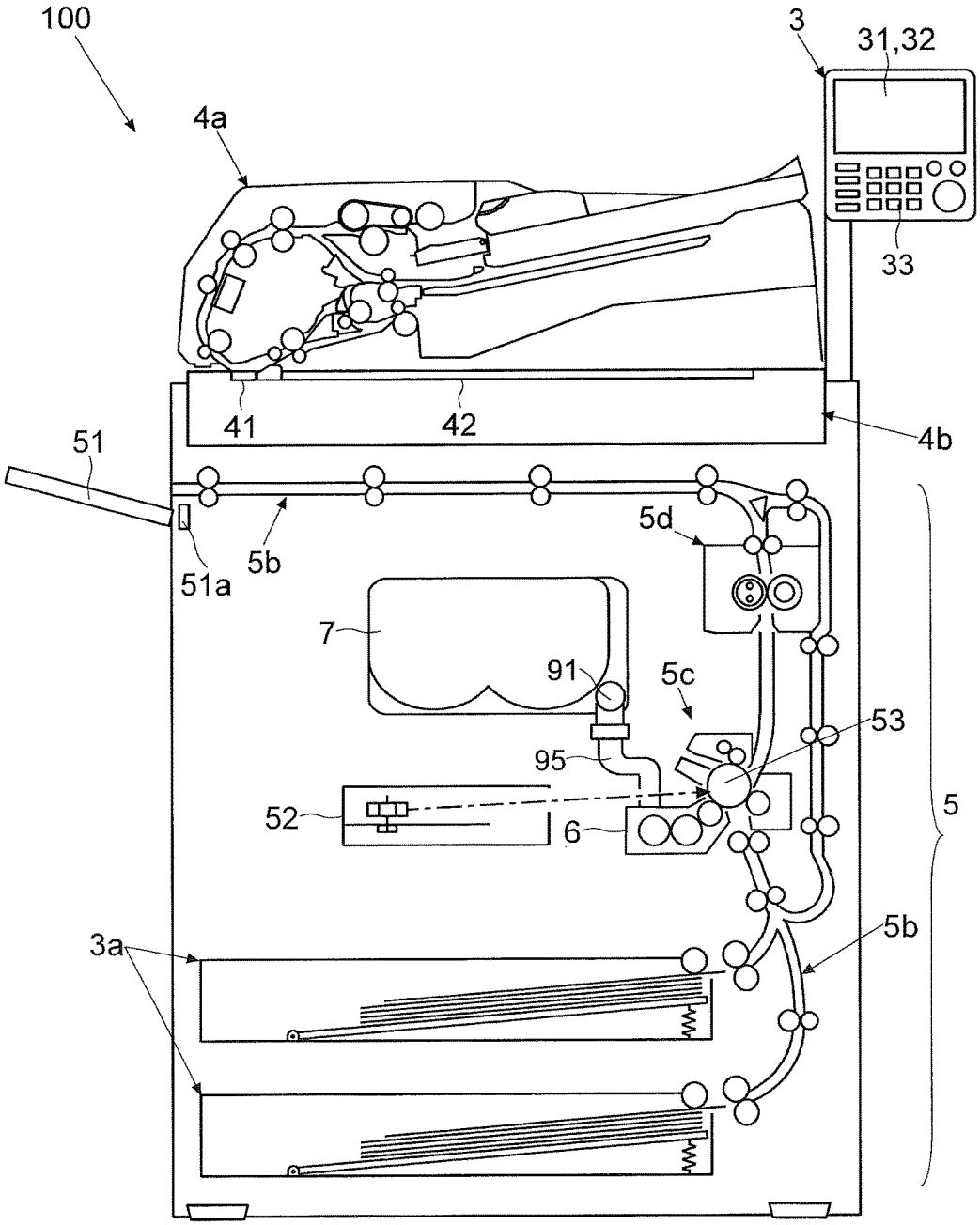
FIG. 2 is a diagram showing an example of the multifunctional machine according to the embodiment.

As shown in FIGS. 1 and 2, the multifunctional peripheral 100 includes an operation portion 3. The operation portion 3 includes a display 31 which displays information (the state, various types of messages and various types of setting screens) on the multifunctional peripheral 100. The display 31 produces a display on the remaining amount in a toner container 7 (details of which will be described later). On the upper surface of the display 31, a touch panel 32 is provided. The touch panel 32 is used for detecting a touch position of the user, and outputs a voltage (signal) corresponding to the detected position. In the operation portion 3, a plurality of hard keys 33 such as a start key and a numeric keypad are also provided. The display 31 is, for example, a device which produces a display of an LCD, an organic EL or the like.

The control portion 1 controls the display of the display 31. The control portion 1 recognizes, based on the output of the touch panel 32, in the display 31 (the touch panel 32), a position which is pressed and its coordinates to recognize an image (image such as a soft key, a button, a tab or a check box) which is operated. Then, the control portion 1 switches the display of the display 31 according to the operation. The control portion 1 controls the operations of the individual portions of the multifunctional peripheral 100 such as an original document transport portion 4*a*, an image reading portion 4*b*, a print portion 5 and a communication portion 13 such that they are operated according to settings made by the user.

The original document transport portion 4*a* transports an original document set on a reading portion (feeding/reading contact glass 41). The image reading portion 4*b* reads the original document which passes the feeding/reading contact glass 41 or the original document which is set on placement/reading contact glass 42, and thereby generates image data. The control portion 1 controls the operations of the original document transport portion 4*a* and the image reading portion 4*b* when a job such as scanning, printing or transmission is performed. The print portion 5 (a paper feed portion 5*a*, a transport portion 5*b*, the image formation portion 5*c* and a fixing portion 5*d*) performs printing on a sheet with the toner based on the image data.

In a job accompanied by printing, the paper feed portion 5*a* feeds sheets to the transport portion 5*b* one by one. The transport portion 5*b* transports the sheet supplied from the paper feed portion 5*a*. The image formation portion 5*c* forms a toner image based on the image data, and transfers it to the transported sheet. The fixing portion 5*d* fixes the toner image which is transferred to the sheet. The sheet to which the toner has been fixed is ejected to an ejection tray 51.

The multifunctional peripheral 100 includes the communication portion 13. The communication portion 13 includes various types of connectors and sockets and a chip for communication control. The communication portion 13 is connected through a network, a public line or a cable to a computer 200 and a facsimile machine 300 such that the communication portion 13 can communicate with them. The communication portion 13 can exchange e-mails and image data with the computer 200 and the facsimile machine 300. The control portion 1 is connected to the communication portion 13 by a bus or a signal line. In a job accompanied by the transmission and reception of data, the control portion 1 makes the communication portion 13 transmit and receive data. The control portion 1 makes the print portion perform printing based on print data such as image data received from the computer 200 or the facsimile machine 300.

(Supply of Toner to Development Device 6)

Figure 3:
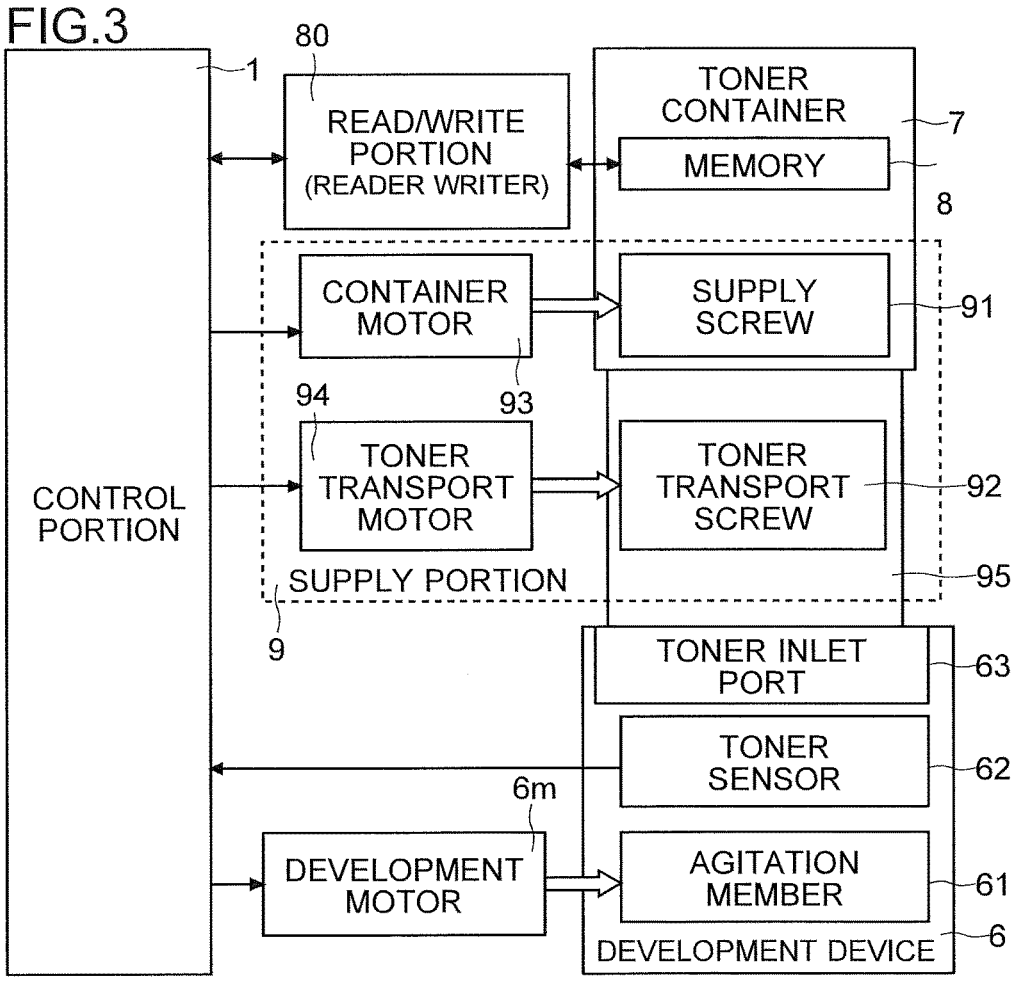
FIG. 3 is a diagram showing an example of a portion in which toner is supplied to a development device in the embodiment.
Figure 4:
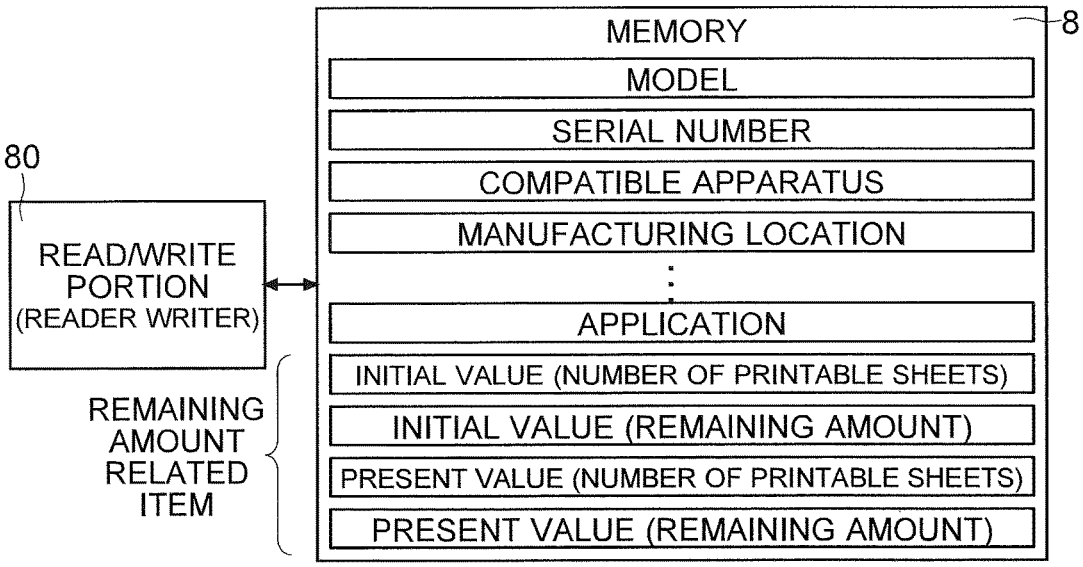
FIG. 4 is a diagram showing an example of contents stored in a memory of a toner container in the embodiment.

An example of the supply of the toner to a development device 6 in the multifunctional peripheral 100 according to the present embodiment will then be described with reference to FIGS. 2 and 3. The image formation portion 5*c* includes the development device 6 which develops, with the toner, an image carrying member (the photosensitive drum 53 of the image formation portion 5*c*) formed on the photosensitive drum 53 by an exposure device 52. The development device 6 incorporates the toner. The development device 6 includes an agitation member 61 which is rotated to agitate the toner. The agitation member 61 plays, for example, roles in uniformly distributing the toner over the longitudinal direction of the development device 6, preventing the toner from being adhered and mixing the newly supplied toner with the toner within the development device 6. As a drive source for rotating the agitation member 61, a development motor 6*m* is provided. During a predetermined period such as the period of printing, the control portion 1 rotates the development motor 6*m* to rotate the agitation member.

An electrostatic latent image is developed by the toner. The toner within the development device 6 is consumed by the development. In order for the toner to be supplied to the development device 6, a toner sensor 62 and a toner inlet port 63 (opening port and supply port) are provided in the development device 6. The supply toner is put into the development device 6 (into the toner chamber of the development device 6) through the toner inlet port 63.

The toner sensor 62 is a sensor for detecting the amount of toner within the development device 6. The toner sensor 62 is a sensor in which an output voltage is varied according to the amount of toner within a detection region (for example, a magnetic sensor, an optical sensor or a pressure sensor). The output voltage of the toner sensor 62 is input to the control portion 1. The control portion 1 determines, based on the output of the toner sensor 62, whether or not the amount of toner within the development device 6 drops below a specified amount.

Within the multifunctional peripheral 100, the toner container 7 is attached. The toner container 7 stores the toner supplied to the development device 6. The toner container 7 is replaceable. When the toner container 7 becomes empty, it is replaced with a new toner container 7. A supply portion 9 supplies (feeds), to the development device 6, the toner stored in the toner container 7. The supply portion 9 includes a supply rotation member (a supply screw 91 and a toner transport screw 92), a supply motor (a container motor 93 and a toner transport motor 94) and a supply pipe 95. The control portion 1 rotates the supply motor to rotate the supply rotation member, and feeds the toner in the toner container 7 to the toner inlet port 63.

The supply screw 91 is provided for the toner container 7. The supply screw 91 is provided in the vicinity of an opening portion provided in the toner container 7. The toner container 7 (the opening portion thereof) and the toner inlet port 63 of the development device 6 are connected with the supply pipe 95. In the supply screw 91, a blade is provided on a rotation shaft. When the control portion 1 determines that the amount of toner within the development device 6 drops below the specified amount, the control portion 1 rotates the container motor 93. The supply screw 91 is rotated by the drive of the container motor 93. When the supply screw 91 is rotated, the toner within the toner container 7 is fed out to the supply pipe 95.

In the supply pipe 95, the toner transport screw 92 in which a blade for feeding the toner is provided on a rotation shaft is provided. In order to rotate the toner transport screw 92, the toner transport motor 94 is provided. The toner transport screw 92 is rotated by the drive of the toner transport motor 94. In this way, the toner within the supply pipe 95 reaches the toner inlet port 63, and the new toner is supplied to (put into) the development device 6.

The control portion 1 continues, while the toner is being supplied, the checking of the output of the toner sensor 62. Then, when the control portion 1 determines that the amount of toner within the development device 6 is equal to or more than the specified amount or when the control portion 1 rotates the supply screw 91 only by the number of revolutions from which the amount of toner within the development device 6 is estimated to be equal to or more than the specified amount, the control portion 1 stops the container motor 93. At the same time or after a given time has elapsed, the control portion 1 also stops the toner transport motor 94. When the control portion 1 continues to rotate the container motor 93 and the toner transport motor 94 for a predetermined time but the output value of the toner sensor 62 does not reach a value corresponding to the specified value or more, the control portion 1 determines that the toner container 7 attached thereto is empty.

In the multifunctional peripheral 100, the toner container 7 and the development device 6 are connected with the supply pipe 95. However, a type of multifunctional peripheral 100 is present in which the toner container 7 is directly connected to the development device 6. In such a type of multifunctional peripheral 100, the supply pipe 95, the toner transport motor 94 and the toner transport screw 92 are not needed.

In the toner container 7, a memory 8 is provided. As the memory 8, an IC tag can be used. Alternatively, the memory 8 may be a substrate which incorporates a storage element. The memory 8 stores various types of data such as a model number, a serial number, compatible apparatues, a manufacturing location, applications of the toner container 7 and the value (value of the remaining amount related item) of an item on the remaining amount of toner.

As the values of the remaining amount related items, the number of printable sheets and the remaining amount can be stored in the memory 8. For the display of the remaining amount, as the values of the remaining amount related items, the initial values and the present values of the number of printable sheets and the remaining amount are stored. The initial value is a value which corresponds to the time when the remaining amount is 100%. The present value is a value which is updated as necessary by repeatedly subtracting a value corresponding to the used amount from the initial value each time one sheet is printed. In the following description, an example where the initial values and the present values of both the number of printable sheets and the remaining amount are stored as the values of the remaining amount related items will be discussed. However, only any one of the number of printable sheets and the remaining amount may be stored. The toner container 7 stores the toner supplied to the development device 6, and includes the memory 8 in which data indicating whether the toner container is the installation toner container 7*i* or the replacement toner container 7*c* and the values of the items (the remaining amount related items) on the remaining amount of toner are written.

In the multifunctional peripheral 100, a read/write portion 80 (reader writer) is provided. The read/write portion 80 is a portion which reads data in the memory 8 and writes data into the memory 8. The read/write portion 80 and the control portion 1 are connected to each other such that they can communicate with each other. When the data in the memory 8 is read, the control portion 1 makes the read/write portion 80 read the data in the memory 8 and receives the read data. The control portion 1 stores the received data in the storage portion 2. When data is written in the memory 8, the control portion 1 transmits data to be written to the read/write portion 80 and makes the read/write portion 80 write the data in the memory 8. When the IC tag is used as the memory 8, the read/write portion 80 serves as a substrate for wirelessly communicating with the IC tag. As described above, the read/write portion 80 reads contents stored in the memory 8 of the toner container 7 attached thereto and writes data in the memory 8.

(Installation of Toner)

The installation of the toner in the multifunctional peripheral 100 according to the embodiment will then be described with reference to FIGS. 5 and 6. The multifunctional peripheral 100 is delivered in a state where the toner is not put into the development device 6. In other words, at the time of the delivery, the development device 6 is empty. Hence, the toner needs to be put into the development device 6 before the use. The first putting of the toner thereinto is referred to as the "installation".

Figure 5:
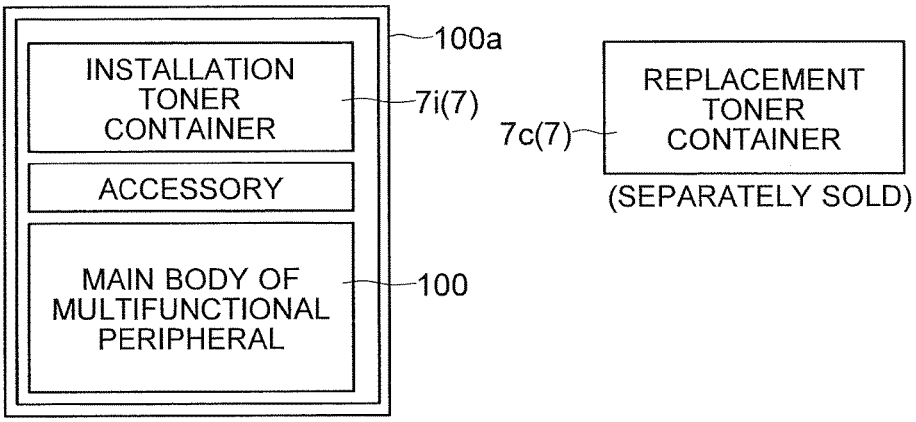
FIG. 5 is a diagram showing an example of the packing of the multifunctional machine according to the embodiment.

As shown in FIG. 5, in the packing member 100*a* (corrugated cardboard) of the entire multifunctional peripheral 100, the installation toner container 7*i* is included. In other words, the installation toner container 7*i* is packed with the multifunctional peripheral 100. The installation toner container 7*i* may be referred to as a "packed container". When after the installation, the toner in the installation toner container 7*i* runs out, the installation toner container 7*i* is replaced with the replacement toner container 7*c* which is generally sold and distributed. The replacement toner container 7*c* is not packed with the packing member 100*a* of the multifunctional peripheral 100, and is sold separately.

The installation toner container 7*i* and the replacement toner container 7*c* may differ in the amount of toner stored. The installation toner container 7*i* is used for the installation, the replacement toner container 7*c* is used for replacement when the toner container 7 becomes empty and they have different applications. In other words, the installation toner container 7*i* is the toner container 7 which is first attached to the multifunctional peripheral 100, and the replacement toner container 7*c* is the toner container 7 which is attached to the multifunctional peripheral 100 for the second or subsequent time. Hence, the data stored in the memory 8 of the installation toner container 7*i* and the data stored in the memory 8 of the replacement toner container 7*c* differ from each other.

In the memory 8 of the installation toner container 7*i*, data indicating its application "the installation toner container 7*i* (packed toner container) is present" is previously written. On the other hand, in the memory 8 of the replacement toner container 7*c*, data indicating its application "the replacement toner container 7*c* is present" is previously written. In the installation toner container 7*i*, the toner is consumed by the installation before printing. Hence, the different initial values of the remaining amount related items (the values of the remaining amount related items) are respectively written in the memory 8 of the installation toner container 7*i* and the memory 8 of the replacement toner container 7*c*.

An example of the flow of the installation of the toner will then be described with reference to FIG. 6. The start of FIG. 6 is the time when the installation of the toner is started. When predetermined installation performance conditions are satisfied, the installation is started.

The installation performance conditions can be determined as necessary. In the multifunctional peripheral 100, when after the delivery, the main power supply is first turned on, the installation is automatically performed. Hence, at the time of delivery, an installation performance flag is written in the storage portion 2. The control portion 1 checks the storage portion 2 at the time of startup. Then, when the installation performance flag is set (the installation performance flag is stored in the storage portion 2), the control portion 1 starts process related to the installation. After the completion of the installation, the control portion 1 clears the installation performance flag in the storage portion 2. The control portion 1 can confirm, based on whether or not the installation performance flag in the storage portion 2 is present, whether or not the installation has already been performed. To input an instruction to perform the installation to the operation portion 3 may be set at the installation performance conditions. In this case, after the multifunctional peripheral 100 is delivered and installed and the main power supply is turned on, the installation can be started at the desired time.

With the start of the installation, the control portion 1. starts the operations of the supply portion 9 and the development motor 6*m* to start the supply of the toner to the development device 6 (step #11). The control portion 1 starts the rotation of the container motor 93, the toner transport motor 94 and the development motor 6*m*. In this way, the toner in the toner container 7 is fed into the development device 6. Then, the control portion 1 checks the output of the toner sensor 62 to confirm whether or not the amount of toner within the development device 6 reaches the specified amount (step #12). When the amount of toner within the development device 6 does not reach the specified amount (no in step #12), the control portion 1 continues the supply of the toner to the development device 6 (continues the operations of the supply portion 9 and the development motor 6*m*, step #13). Then, the flow is returned to step #12.

When the amount of toner within the development device 6 reaches the specified amount (yes in step #12), the control portion 1 stops the operations of the supply portion 9 and the development motor 6*m* to stop the supply of the toner to the development device 6 (step #14). Then, the flow (installation) is completed (end). As described above, when the predetermined installation performance conditions are satisfied, the control portion 1 makes the supply portion 9 perform the installation in which the toner is put into the development device 6 where no toner is present.

(Setting of Value of Remaining Amount Related Item in fi)

An example of the setting of the value of the remaining amount related item in the installation toner container 7*i* of the multifunctional peripheral 100 according to the embodiment will then be described with reference to FIGS. 7 and 8.

The installation toner container 7*i* is packed so as to be attached to (so as to be used in) the multifunctional peripheral 100 at the time of the installation. In other words, the installation toner container 7*i* is recommended as the toner container 7 which is first attached to the multifunctional peripheral 100 after the delivery of the multifunctional peripheral 100.

Figure 7:
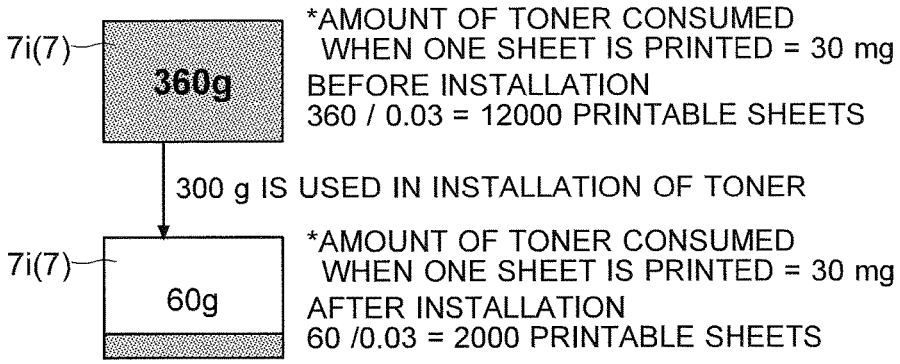
FIG. 7 is a diagram showing an example of the consumption of the toner in the installation.

FIG. 7 shows an example of the toner consumed when the genuine installation toner container 7*i* is attached to the multifunctional peripheral 100 and the installation is performed. The initial amount (full amount) of toner in the installation toner container 7*i* shown in FIG. 7 is 360 g (grams). With the assumption that the amount of toner consumed when one sheet is printed is 30 mg, the installation toner container 7*i* stores the toner with which it is possible to print 12000 sheets before the installation.

FIG. 7 shows an example where 300 g of the toner in the installation toner container 7*i* is consumed by the installation. The toner left in the installation toner container 7*i* after the installation is 60 g. Thereafter, in order to prevent damage and a decrease in image quality, the amount of toner within the development device 6 are maintained. With the assumption that the amount of toner consumed when one sheet is printed is 30 mg, 60 g of the toner is used, and thus it is possible to print 2000 sheets. In the installation toner container 7*i*, it is possible to print about 2000 sheets until the installation toner container 7*i* becomes empty after the installation.

The amount of toner stored in the installation toner container 7*i* is previously determined. Since the amount of toner consumed in the installation is determined in the specifications, it is substantially constant though some errors are produced. When how many sheets can be subsequently printed is predicted, the amount of toner consumed when one sheet is printed is also previously determined. In the memory 8 of the installation toner container 7*i*, values based on the remaining amount of toner within the container after the installation are previously stored as the values of the remaining amount related items. For example, 60 g of the amount of toner after the installation and 2000 sheets of the number of printable sheets are previously written as the initial values of the remaining amount related items in the memory 8 of the installation toner container 7*i*. In the memory 8 of the installation toner container 7*i*, the number of sheets which can be printed with the remaining amount of toner after the installation and the remaining amount of toner after the installation process in the specifications are previously stored as the initial values of the remaining amount related items. Since it is assumed that the initial value of the remaining amount related item=the first present value, in the memory 8 of the installation toner container 7*i*, the same value as the initial value may be previously stored as the present value of the remaining amount related item.

However, as described previously, without use of the packed toner container (installation toner container 7*i*), the irregular installation may be performed. Consequently, an unused (extra) installation toner container 7*i* may be used as the replacement toner container 7*c*. In other words, when a certain toner container 7 becomes empty, the toner container 7 may be replaced with the unused installation toner container 7*i*.

Conventionally, as the values of the remaining amount related items, the values based on the remaining amount of toner within the container after the installation are previously stored in the memory 8 of the installation toner container 7*i*. In the example described above, in the installation toner container 7*i*, as the initial value of the remaining amount related item, 2000 sheets of the number of printable sheets is stored in the memory 8. The first present value of the value of the remaining amount related item is set at 2000 sheets so as to correspond to the initial value.

With the assumption that the initial amount (full amount) of toner in the installation toner container 7*i* is 360 g and that the amount of toner consumed when one sheet is printed is 30 mg, the toner capable of printing 12000 sheets is stored in the unused installation toner container 7*i*. However, since the number of printable sheets stored in the memory 8 is 2000 sheets, a display in which the remaining amount in the toner container 7 is zero is conventionally produced when the 2000 sheets are printed. However, about 80% (300/360) of the toner is actually left in the installation toner container 7*i*.

Conventionally, when the installation toner container 7*i* is used as the replacement toner container 7*c*, though a large amount of toner is left, the value (present value) on the remaining amount stored in the memory 8 is the value corresponding to the remaining amount of zero. Hence, when the toner is irregularly used, the remaining amount obtained by calculation greatly differs from the actual remaining amount of toner within the toner container 7.

A system may be used in which when the value (present value) of the remaining amount related item is the value corresponding to the remaining amount of zero or when the value of the remaining amount related item approaches zero, the replacement toner container 7*c* is automatically ordered. In this system, the replacement toner container 7*c* is automatically ordered with timing at which it is not necessary to place the order. The automatic order of the toner container 7 in an inappropriate manner contributes to customer complaints.

When in a state where the remaining amount is zero, it is not detected that the toner container 7 is empty, an unauthorized toner is determined to be put thereinto, with the result that a warning display may be produced (the operation may be stopped depending on the situation). Although the genuine toner container 7 is used, a warning is provided or the operation is stopped, and this provides a sense of mistrust to a customer or causes a customer to mistakenly believe that a failure occurs. This contributes to customer complaints.

Hence, the multifunctional peripheral 100 adjusts the value of the remaining amount related item stored in the memory 8 depending on whether or not the installation toner container 7*i* is used for the installation. An example of the flow of the adjustment of the value of the remaining amount related item will be described below with reference to FIG. 8.

Figure 8:
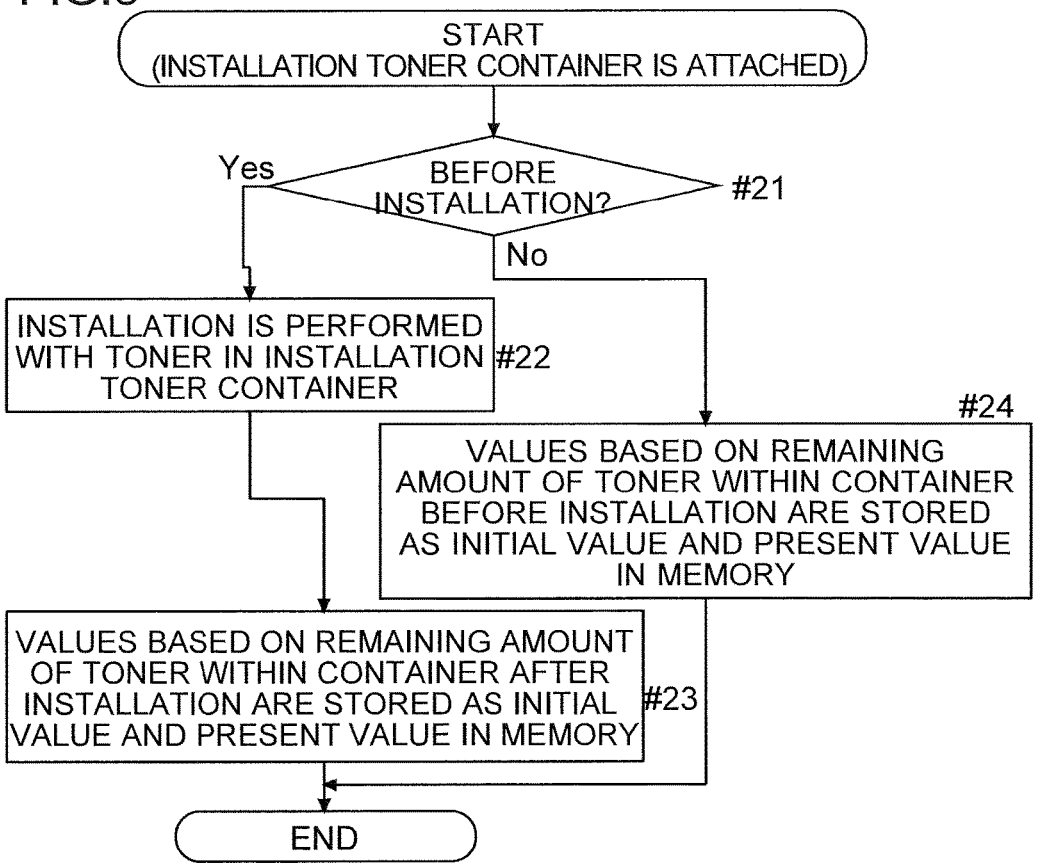
FIG. 8 is a flowchart showing an example of the flow of setting of values of remaining amount related items in an installation toner container in the embodiment.

The start of FIG. 8 is the time when the control portion 1 recognizes that the toner container 7 newly attached to the multifunctional peripheral 100 is the installation toner container 7*i*. The control portion 1 checks data stored in the memory 8 to determine whether the new toner container 7 is the installation toner container 7*i* or the replacement toner container 7*c*. The control portion 1 makes the read/write portion 80 periodically read contents in the memory 8 of the toner container 7. The control portion 1 checks data like a serial number of the data stored in the memory 8 to recognize that the new toner container 7 is attached (the toner container 7 is replaced).

The control portion 1 checks whether the installation of the toner has not been performed (step #21). For example, when after the delivery, in a state where the installation toner container 7*i* is attached, power is first turned on, the control portion 1 recognizes that the attached toner container 7 is the installation toner container 7*i* and that the installation has not been performed.

Figure 6:
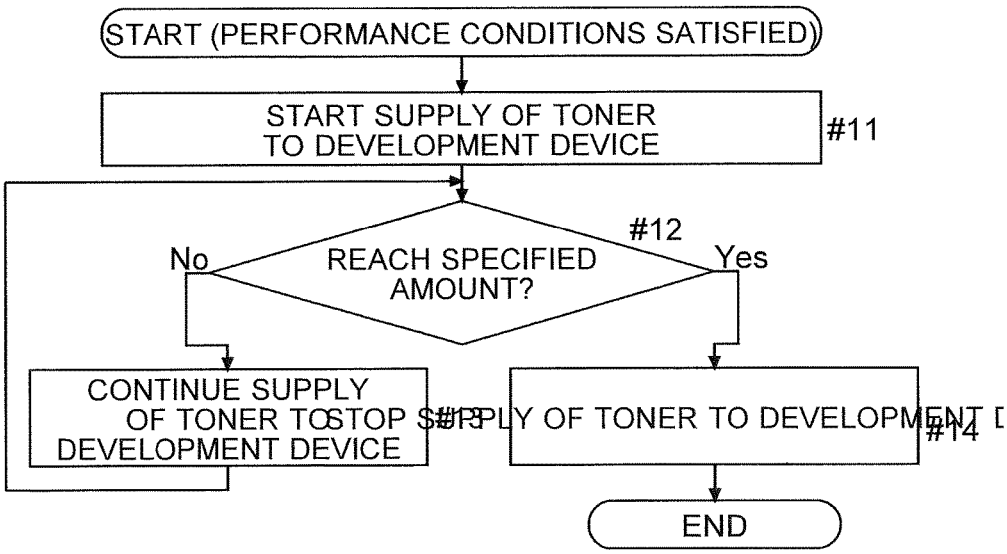
FIG. 6 is a flowchart showing an example of the flow of installation of the toner in the multifunctional machine according to the embodiment.

When the installation has not been performed (yes in step #21), the control portion 1 uses the installation toner container 7*i* to perform the installation (step #22, the flow of FIG. 6). Then, the control portion 1 stores, as the initial value and the present values of the remaining amount related items, values based on the remaining amount of toner within the container after the installation in the memory 8 of the installation toner container 7*i* (the first present value=the initial value, step #23). The memory 8 of the installation toner container 7*i* according to the present embodiment previously stores the remaining amount of toner after the installation and the number of printable sheets as the initial values of the remaining amount related items (may store them as the present values). Hence, in the case of step #23, the control portion 1 does not change the initial values of the remaining amount related items, and stores, in the memory 8, the remaining amount of toner after the installation and the number of printable sheets as the present values. Then, the flow is completed (end).

For example, it is assumed that the initial amount (full amount) of toner in the installation toner container 7*i* is 360 g, that the amount of toner consumed when one sheet is printed is 30 mg and that the amount of toner consumed by the installation is 300 g. In this case, in step #23, the control portion 1 stores, in the memory 8 of the installation toner container 7*i*, as the initial values and the present values of the remaining amount related items, "60 g" of the remaining amount and "2000 sheets" of the number of printable sheets.

Even when the installation has already been performed (no in step #21), and the installation toner container 7*i* is attached, it is not necessary to perform the installation. Then, the control portion 1 stores, in the memory 8 of the installation toner container 7*i*, as the initial values and the present values of the remaining amount related items, values based on the remaining amount of toner within the container before the installation (the first present value=the initial value, step #24). Specifically, the control portion 1 makes the read/write portion 80 write, in the memory 8 of the installation toner container 7*i*, as the initial values and the present values of the remaining amount related items, the remaining amount of toner before the installation and the number of sheets which can be printed with the remaining amount of toner. In this way, the value (present value) of the remaining amount related item stored in the memory 8 is brought close to the actual amount of toner left in the installation toner container 7*i*. Then, the flow is completed (end).

For example, with the assumption that the initial amount (full amount) of toner in the installation toner container 7*i* is 360 g and that the amount of toner consumed when one sheet is printed is 30 mg, in step #24, the control portion 1 stores, in the memory 8 of the installation toner container 7*i*, as the initial values and the present values of the remaining amount related items, "360 g" of the remaining amount and "12000 sheets" of the number of printable sheets.

(Display of Remaining Amount Based on Values of Remaining Amount Related Items)

An example of the display of the remaining amount based on the values of the remaining amount related items in the multifunctional peripheral 100 according to the embodiment will then be described with reference to FIGS. 9 and 10.

On the operation portion 3 of the multifunctional peripheral 100, a display related to the remaining amount of toner is produced. As shown in FIG. 9, the number of printable sheets and a ratio of the present remaining amount of toner to the full amount of toner (the present value/the initial value) are displayed. As the display related to the remaining amount of toner, both the number of printable sheets and the ratio may be displayed or any one of them may be displayed.

In a region on a strap along the lower side of the display region of the display 31, the number of printable sheets and the ratio are displayed. A setting screen 34 shown in FIG. 9 is one of setting screens on copying. Even in the other setting screens, a region on a strap along the lower side is displayed. Hence, even when any one of the setting screens is displayed, the number of printable sheets and the ratio are displayed. A special screen for displaying the remaining amount may be prepared, and when a predetermined operation for displaying the special screen is performed on the touch panel 32, the control portion 1 may display the number of printable sheets and the ratio on the display 31.

The control portion 1 displays the number of printable sheets and the ratio based on the initial values and the present values of the remaining amount related items set in the flow of FIG. 8. Hence, an example of the flow of the display on the remaining amount in a state where the installation toner container 7*i* is attached will be described with reference to FIG. 9.

Figure 9:
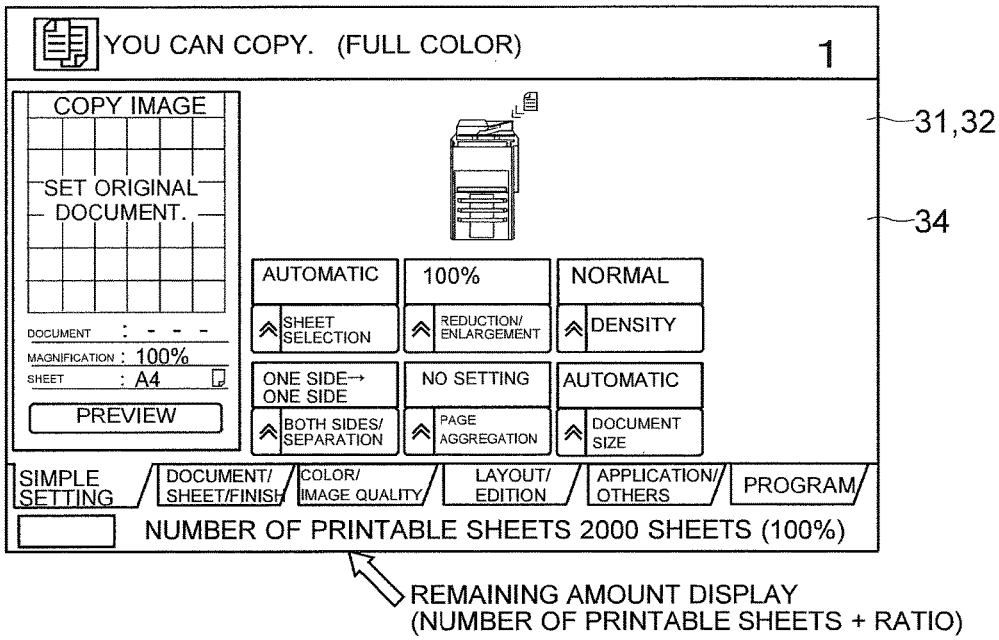
FIG. 9 is a diagram showing an example of a setting screen in the multifunctional machine according to the embodiment.
Figure 10:
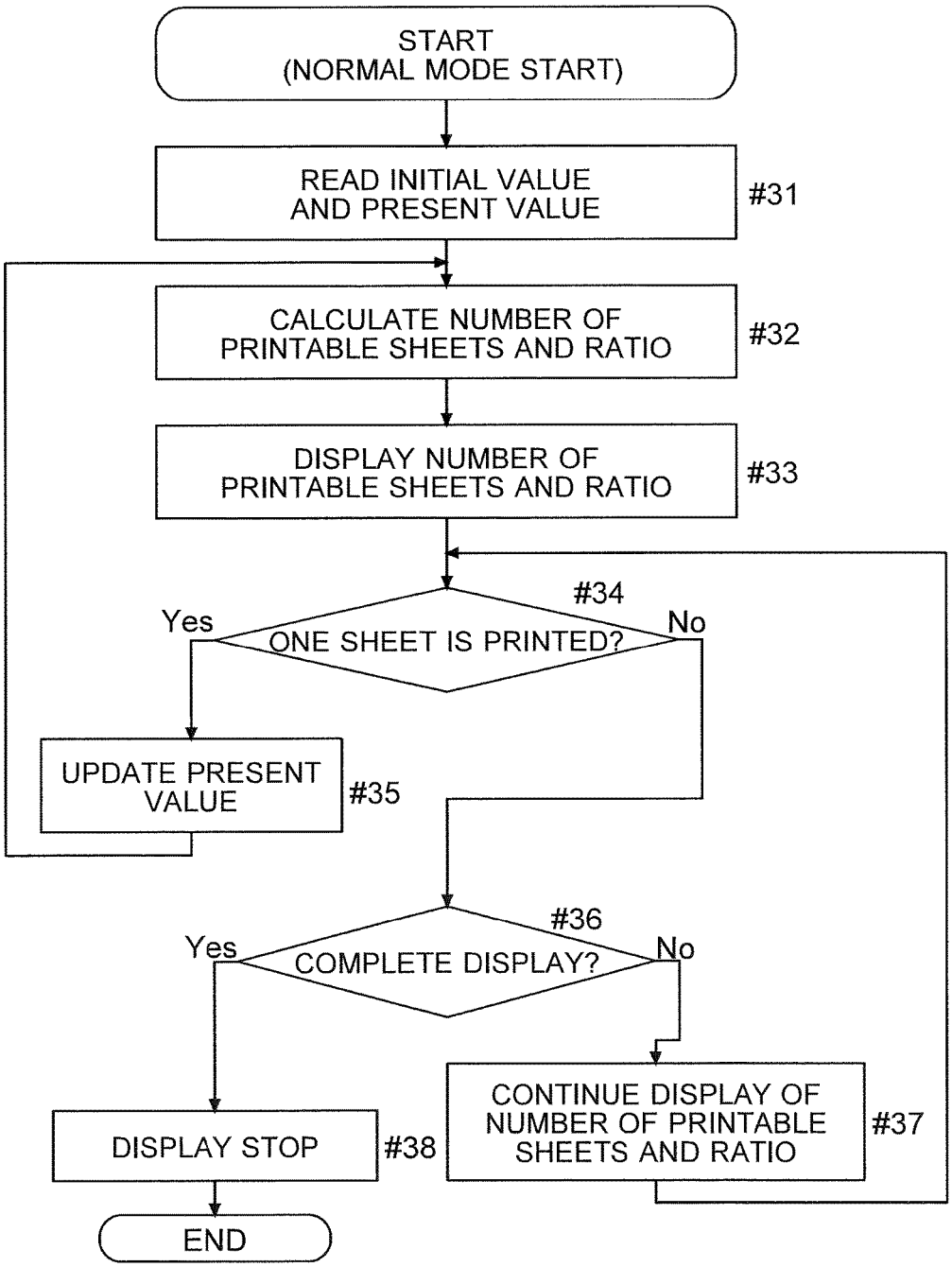
FIG. 10 is a diagram showing an example of the flow of a display of the remaining amount based on the values of the remaining amount related items in the multifunctional machine according to the embodiment.

The start of FIG. 9 is the time when the control portion 1 starts to produce a display on the display 31. The main power supply of the multifunctional peripheral 100 is turned on, and thus when the multifunctional peripheral 100 is started up in a normal mode (standby mode) or when the mode is returned from a power-saving mode to the normal mode (standby mode), the control portion 1 makes the display 31 produce a display. When predetermined transfer conditions are satisfied, the multifunctional peripheral 100 is transferred to the power-saving mode. For example, the transfer conditions are that the operation portion 3 is not operated for a predetermined time after any one of the time of completion of a job, the time of the start-up and the time of the return. When in the power-saving mode, predetermined return conditions are satisfied, the multifunctional peripheral 100 is returned from the power-saving mode to the normal mode. For example, the return conditions are that an operation is performed on the operation portion 3 or that a print job is received by the communication portion 13.

The control portion 1 makes the read/write portion 80 read the initial values and the present values of the remaining amount related items from the memory 8 of the attached installation toner container 7*i* (step #31). Then, the control portion 1 determines the number of printable sheets and the ratio based on the initial values and the present values of the remaining amount related items (step #32). When only the number of printable sheets is displayed as the remaining amount, only the number of printable sheets is preferably determined. When only the ratio is displayed as the remaining amount, only the ratio is preferably determined.

When the ratio is determined based on the initial value and the present value of the number of printable sheets, the control portion 1 determines, as the ratio to be displayed, a value which is obtained by multiplying a value obtained by dividing the present value of the number of printable sheets by the initial value by 100. Decimal digits are rounded off, rounded up or rounded down. The control portion 1 determines the present value (the number of printable sheets) of the remaining amount related item as the number of printable sheets to be displayed.

When the ratio is determined based on the initial value and the present value of the remaining amount, the control portion 1 determines, as the ratio to be displayed, a value which is obtained by multiplying a value obtained by dividing the present value by the initial value by 100. The control portion 1 determines, as the number of printable sheets to be displayed, a value which is obtained by dividing the present value of the remaining amount by the predetermined amount of toner consumed when one sheet is printed. The decimal digits of the value obtained by the computation are rounded off, rounded up or rounded down. The amount of toner consumed when one sheet is printed is previously determined and is stored in the memory 8 or the storage portion 2.

The control portion 1 displays, on the display 31, the ratio and the number of printable sheets which are determined or defined (step #33). The control portion 1 displays, on the display 31, the ratio of integers and the number of printable sheets.

Then, the control portion 1 checks, through a print job (copy job or print job), whether or not one sheet is printed (step #34). The control portion 1 recognizes that one sheet is printed at a predetermined time such as when the exposure of one page on the photosensitive drum 53 is completed or when the ejection of the sheet is detected by an ejection sensor 51*a* (see FIG. 2) placed at the ejection port of the sheet (step #34).

When one sheet is printed (yes in step #34), the control portion 1 makes the read/write portion 80 update the present value of the remaining amount related item (step #35). In this way, the present value of the remaining amount related item stored in the memory 8 of the installation toner container 7*i* is updated.

Specifically, for the number of printable sheets, the control portion 1 makes the read/write portion 80 perform an update in which each time one page (sheet) is printed, one is subtracted from the present value of the remaining amount related item. For the remaining amount, the control portion 1 makes the read/write portion 80 perform an update in which each time one page is printed, the predetermined amount of toner consumed when one sheet is printed is subtracted from the present value of the remaining amount related item. As described above, the initial values and the present values of the remaining amount related items are stored in the memory 8. The initial values may be stored in the storage portion 2 in a nonvolatile manner.

Then, the flow is returned to step #32. When a plurality of sheets are continuously printed, the process from step #32 to step #35 is looped. Hence, the number of printable sheets and the remaining amount which are displayed are updated each time one page (sheet) is printed.

On the other hand, when printing is not performed (no in step #34), the control portion 1 checks, through the transfer to the power-saving mode or the turning off of the main power supply of the multifunctional peripheral 100, whether or not the display of the display 31 needs to be completed (step #36). When the display of the display 31 does not need to be completed (no in step #36), the control portion 1 makes the display 31 continue to display the number of printable sheets and the ratio which are determined immediately before (step #37). Then, the flow is returned to step #34. In a state where printing is not performed in the normal mode, the flow is looped between no in step #34 and step #37. On the other hand, when the display of the display 31 needs to be completed (yes in step #36), the control portion 1 makes the display 31 stop the display including the display of the remaining amount (step #38). Specifically, the control portion 1 makes the display 31 disappear. Then, the flow is completed (end).

In this way, the image forming apparatus (the multifunctional peripheral 100) according to the embodiment includes: the display 31 which displays information on the image forming apparatus (the multifunctional peripheral 100); the development device 6 which supplies toner to develop the electrostatic latent image formed on the photosensitive drum 53; the toner container 7 which stores the toner supplied to the development device 6 and to which the memory 8 is attached that data indicating whether the toner container 7 is the installation toner container 7*i* or the replacement toner container 7*c* and the value of the remaining amount related item which is the item related to the remaining amount of the toner are written in; the supply portion 9 (the container motor 93, the toner transport motor 94, the supply screw 91, the toner transport screw 92 and the supply pipe 95) which supplies the toner stored in the toner container 7 to the development device 6; the read/write portion 80 which reads contents stored in the memory 8 attached to the toner container 7 and which writes information in the memory 8; and the control portion 1 in which the read/write portion 80 is made to perform update process where the present value of the remaining amount related item is gradually reduced, according to the number of sheets printed, from the initial value of the remaining amount related item, and the present value is recognized based on the reading of the read/write portion 80. In the control portion 1, when the predetermined installation performance condition is satisfied, the supply portion 9 is made to perform the installation where the toner is put into the development device 6 containing no toner, when the installation is performed in a state where the installation toner container 7*i* is attached, a value based on the remaining amount of the toner within the container after the installation is stored as the initial value in the memory 8 of the installation toner container 7*i* and when the installation toner container 7*i* is attached in a state where the installation has already been performed, a value based on the remaining amount of the toner within the container before the installation is stored as the initial value in the memory 8 of the installation toner container 7*i*.

In this way, when the installation toner container 7*i* is used for the installation, the initial value of the remaining amount related item can be set at the value based on the remaining amount of toner after the installation. When the installation toner container 7*i* is used as the replacement toner container 7*c*, the initial value of the remaining amount related item can be set at the value based on the remaining amount of toner before the installation (when the installation is not performed). Hence, regardless of whether or not the installation toner container 7*i* is used for the installation, the value of the remaining amount related item can be set at a value corresponding to the actual remaining amount of toner in the installation toner container 7*i*.

The system may be used in which when the value of the remaining amount related item is the value corresponding to the remaining amount of zero or when the value of the remaining amount related item approaches zero (for example, a value corresponding to about 10% of the remaining amount), the replacement toner container 7*c* is automatically ordered. Even when the installation toner container 7*i* is used as the replacement toner container 7*c*, the value of the remaining amount related item is set at the value corresponding to the actual remaining amount of toner. Hence, it is possible to prevent the toner container 7 from being erroneously ordered in a state where a large amount of toner is left.

A failure may occur in the image forming apparatus (the multifunctional peripheral 100) due to an inappropriate act such as a change in the contents stored in the memory 8 or the supply of an unauthorized toner to the empty toner container 7. In order for the failure resulting from the inappropriate act on the toner to be prevented, when a given number of sheets are continuously printed without the replacement of the toner container 7 after the value of the remaining amount related item becomes the value corresponding to the remaining amount of zero, a warning may be notified or the occurrence of an error may be detected. Conventionally, in the memory 8 of the installation toner container 7*i*, the value of the remaining amount related item with reference to the remaining amount of toner after the installation is previously stored. When the installation toner container 7*i* is used as the replacement toner container 7*c*, since even in a state where the value of the remaining amount related item is the value corresponding to the remaining amount of zero, the toner is sufficiently left in the toner container 7, printing can be continued. Even when printing is continued with the genuine installation toner container 7*i*, as described above, a warning may be notified or the occurrence of an error may be detected. Since in the multifunctional peripheral 100, the value of the remaining amount related item is the value corresponding to the actual remaining amount of toner, even when the installation toner container 7*i* is used as the replacement toner container 7*c*, an erroneous warning and an erroneous detection are not performed.

The remaining amount related item may be set at the number of printable sheets. The control portion 1 stores, in the memory 8, as the initial value and the present value, the number of sheets that can be printed with the remaining amount of toner within the container after the installation when the toner container 7 attached at the time of the installation is the installation toner container 7*i*, stores, in the memory 8, as the initial value and the present value, the number of sheets that can be printed with the remaining amount of toner within the container before the installation when in a state where the installation has already been performed, the installation toner container 7*i* that is unused is attached, makes the read/write portion 80 perform an update in which one is subtracted from the present value each time one page is printed and displays, on the display 31, either or both of a ratio obtained by dividing the present value by the initial value and the present value.

In this way, in any one of a case where the installation toner container 7*i* is used for the installation and a case where the installation toner container 7*i* is used as the replacement toner container 7*c*, it is possible to display the accurate number of printable sheets and the accurate ratio. Even when the installation toner container 7*i* is irregularly used as the replacement toner container 7*c*, the number of printable sheets and the ratio which correspond to the actual remaining amount are displayed. Hence, the user can find the accurate amount of toner left in the container. It is also possible to prevent the replacement toner container 7*c* from being erroneously ordered even when a large amount of toner is left in the toner container 7.

The memory 8 of the installation toner container 7*i* previously stores, as the initial value and the present value, the number of sheets that can be printed with the remaining amount of toner after the installation. In this way, only when the installation toner container 7*i* is irregularly used as the replacement toner container 7*c*, the initial value and the present value of the remaining amount related item are preferably rewritten.

The remaining amount related item may be set at the remaining amount of the toner within the container. The control portion 1 stores, in the memory 8, as the initial value and the present value, the remaining amount of the toner within the container in a state where the installation has already been performed when the toner container 7 attached at the time of the installation is the installation toner container 7*i*, stores, in the memory 8, as the initial value and the present value, the remaining amount of the toner within the container before the installation when in the state where the installation has already been performed, the installation toner container 7*i* that is unused is attached, makes the read/write portion 80 perform an update in which a predetermined amount of the toner consumed when one sheet is printed is subtracted from the present value each time one page is printed and displays, on the display 31, either or both of a ratio obtained by dividing the present value by the initial value and a value obtained by dividing the present value by the predetermined amount of the toner consumed when one sheet is printed.

In this way, in any one of a case where the installation toner container 7*i* is used for the installation and a case where the installation toner container 7*i* is used as the replacement toner container 7*c*, it is possible to display the accurate ratio and the accurate number of printable sheets. Even when the installation toner container 7*i* is irregularly used as the replacement toner container 7*c*, since the number of printable sheets and the ratio which are erroneous are not displayed, the user can find the accurate amount of toner left in the container. It is also possible to prevent the replacement toner container 7*c* from being erroneously ordered even when a large amount of toner is left in the toner container 7.

The memory 8 of the installation toner container 7*i* previously stores, as the initial value, the remaining amount of the toner after the installation process. In this way, only when the installation toner container 7*i* is irregularly used as the replacement toner container 7*c*, the initial value and the present value of the remaining amount related item are preferably rewritten.

Although the embodiment of the present disclosure is described, the scope of the present disclosure is not limited to the embodiment, and various modifications are possible without departing from the spirit of the disclosure.

What is claimed is:

1. An image forming apparatus comprising:

a display which displays information;

a development device which supplies toner to develop an electrostatic latent image formed on a photosensitive drum;

a toner container which stores the toner supplied to the development device and to which a memory is attached that data indicating whether the toner container is an installation toner container or a replacement toner container and a value of a remaining amount related item which is an item related to a remaining amount of the toner are written in;

a supply portion which supplies the toner stored in the toner container to the development device;

a read/write portion which reads contents stored in the memory attached to the toner container and which writes information in the memory; and a control portion in which the read/write portion is made to perform update process where a present value of the remaining amount related item is gradually reduced, according to a number of sheets printed, from an initial value of the remaining amount related item, the present value is recognized based on the reading of the read/write portion, when a predetermined installation performance condition is satisfied, the supply portion is made to perform installation where the toner is put into the development device containing no toner, when the installation is performed in a state where the installation toner container is attached, a value based on the remaining amount of the toner within the container after the installation is stored as the initial value in the memory and when the installation toner container is attached in a state where the installation has already been performed, a value based on the remaining amount of the toner within the container before the installation is stored as the initial value in the memory.

2. The image forming apparatus according to claim 1, wherein the remaining amount related item is a number of printable sheets, and the control portion stores, in the memory, as the initial value and the present value, a number of sheets that can be printed with the remaining amount of the toner within the container after the installation when the toner container attached at a time of the installation is the installation toner container, stores, in the memory, as the initial value and the present value, a number of sheets that can be printed with the remaining amount of the toner within the container before the installation when in a state where the installation has already been performed, the installation toner container that is unused is attached, makes the read/write portion perform an update in which one is subtracted from the present value each time one page is printed and displays, on the display, either or both of a ratio obtained by dividing the present value by the initial value and the present value.

3. The image forming apparatus according to claim 1, wherein the memory of the installation toner container previously stores, as the initial value and the present value, a number of sheets that can be printed with the remaining amount of the toner after the installation.

4. The image forming apparatus according to claim 1, wherein the remaining amount related item is the remaining amount of the toner within the container, and the control portion stores, in the memory, as the initial value and the present value, the remaining amount of the toner within the container after the installation when the toner container attached at a time of the installation is the installation toner container, stores, in the memory, as the initial value and the present value, the remaining amount of the toner within the container before the installation when in a state where the installation has already been performed, the installation toner container that is unused is attached, makes the read/write portion perform an update in which a predetermined amount of the toner consumed when one sheet is printed is subtracted from the present value each time one page is printed and displays, on the display, either or both of a ratio obtained by dividing the present value by the initial value and a value obtained by dividing the present value by the predetermined amount of the toner consumed when one sheet is printed.

5. The image forming apparatus according to claim 1, wherein the memory of the installation toner container previously stores, as the initial value, the remaining amount of the toner after the installation.

6. The image forming apparatus according to claim 1, wherein the installation toner container is a toner container which is packed with a packing member of the image forming apparatus, and in the memory of the installation toner container, data indicating an application of the installation toner container is previously written.

7. The image forming apparatus according to claim 1, wherein when an installation performance flag is stored in a storage portion, the control portion starts process on the installation, when the installation is completed, the installation performance flag in the storage portion is cleared and whether or not the installation has already been performed is checked based on whether or not the installation performance flag is present in the storage portion.

8. A method of controlling an image forming apparatus, the method comprising:

supplying toner to develop an electrostatic latent image formed on a photosensitive drum;

storing the toner in a toner container to which a memory is attached;

writing, in the memory, data indicating whether the toner container is an installation toner container or a replacement toner container and a value of a remaining amount related item which is an item related to a remaining amount of the toner;

supplying the toner stored in the toner container to a development device;

reading contents stored in the memory and writing information in the memory;

performing update process where a present value of the remaining amount related item is gradually reduced, according to a number of sheets printed, from an initial value of the remaining amount related item;

performing installation where the toner is put into the development device containing no toner when a predetermined installation performance condition is satisfied;

storing, as the initial value, in the memory, a value based on the remaining amount of the toner within the container after the installation when the installation is performed in a state where the installation toner container is attached; and storing, as the initial value, in the memory, a value based on the remaining amount of the toner within the container before the installation when the installation toner container is attached in a state where the installation has already been performed.

* * * * *